US006142528A

United States Patent [19]

Riley

[11] Patent Number: 6,142,528

[45] **Date of Patent: *Nov. 7, 2000**

[54] ADJUSTABLE ICE SKATE STORAGE AND WALKING SHOE

[76] Inventor: Richard A Riley, 67420 Central Ave., Bridgeport, Ohio 43912

[ * ] Notice: This patent is subject to a terminal disclaimer.

[21] Appl. No.: 09/184,892

[22] Filed: Nov. 3, 1998

[51] Int. Cl.[7] ..... A63C 3/12

[52] U.S. Cl. ..... 280/825

[58] Field of Search ..... 280/825, 7.13, 280/11.19, 809; 30/151, 286, 382, 295

[56] References Cited

U.S. PATENT DOCUMENTS 4,392,674 7/1983 Evon ..... 280/825
5,513,881 5/1996 DiMeglio ..... 280/825
5,765,870 6/1998 Riley ..... 280/825
5,941,568 6/1998 White ..... 280/825

*Primary Examiner*—Kevin Hurley
*Assistant Examiner*—Kevin McKinley
*Attorney, Agent, or Firm*—Gerald A. Baracka

[57] ABSTRACT

An adjustable shoe for ice skates, consisting of a front portion and a rear portion which are connected by a track that permits the front and rear portions to be moved relative to one another. A cavity in the front and rear shoe portions to receive the blade of an ice skate with the chassis of the skate riding on the top ridge that surrounds the cavity. Adjustable strap or straps are provided to secure the shoe to an ice skate.

9 Claims, 3 Drawing Sheets

FIG. 4
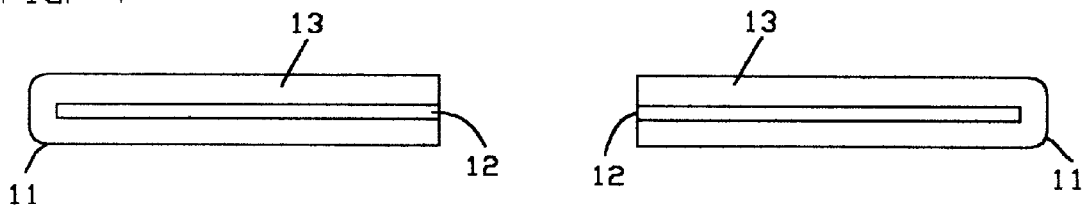
FIG. 5
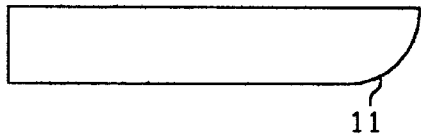
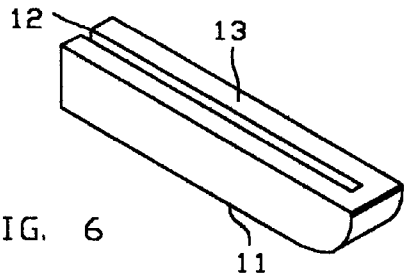
FIG. 6
FIG. 7
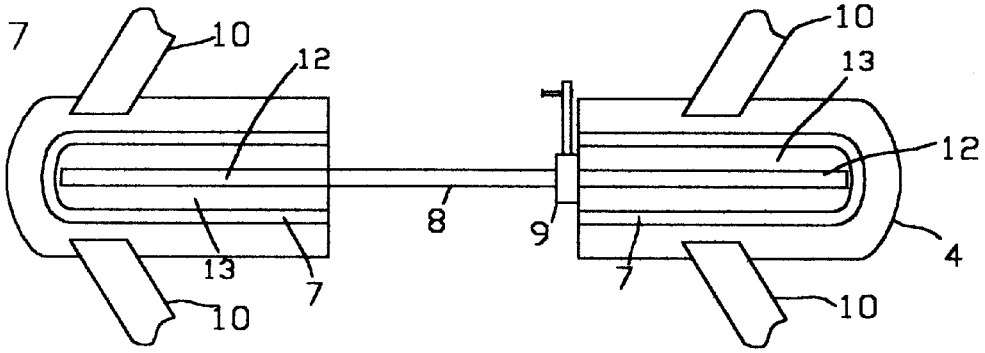

ADJUSTABLE ICE SKATE STORAGE AND WALKING SHOE

FIELD OF INVENTION

The original invention, the adjustable inline skate storage and walking shoe (U.S. Pat. No. 5,765,870), relates to inline skates. This invention relates to an improvement to the adjustable inline skate storage and walking shoe basic concept and converts it to an adjustable ice skate storage and walking shoe. By adding an insert that reduces the size of the cavity to accept an ice skate blade, the adjustable inline skate storage and walking shoe is converted to an adjustable ice skate storage and walking shoe that functions as a comfortable walking shoe while wearing ice skates, giving ankle support and stability. This invention also keeps the ice skate blade in suspension which eliminates dulling of the blade that occurs when walking in conventional ice skate guards. This invention can also be used to maintain the ice skate in an upright position for convenient storage.

BACKGROUND OF THE INVENTION

Ice skates and inline skates, also known as roller blade skates, are well known. Likewise, ice skate blade guards are also well known. Generally, ice skate blade guards are usually made from a relatively soft material such as rubber, nylon or similar material to minimize damage to the sharp edge of a skate runner, where sharp ice skate blades are important for safe and competent ice skating. Ice skate blade guards typically are long and narrow with a slot provided in the soft material to fit the ice skate blade into the ice skate blade guard. The ice skate blade guard is further provided with suitable means for securing to and removing from the ice skate blade. Another recognizable feature of ice skate blade guards is that the length is adjustable such that a single product can be adjusted for use with a variety of ice skate sizes.

One problem related to ice skates is that ice skate blade guards, the subject of prior patents, are ½" to ¾" in width. These ice skate blade guards protect the ice skate blade to a degree during walking but provide no comfort or ankle support. The result of poor ankle support provided by available ice skate blade guards can be painful ankles twists and sprains.

Many young persons play hockey and ice skate for recreational purposes. These persons or their parents may put their ice skates on either at home or at the ice skating rink (arena). Because available ice skate blade guards provide poor ankle support, many ice skaters must wait until arriving at the ice skating rink (arena) prior to putting on their ice skates. This can be an inconvenience, especially when one set of parents is driving young persons from several families to the ice skating rink. In addition, during ice skating recesses (periodic breaks used to clean the ice skating rink), ice skaters tend to walk to refreshment stands and play arcade games and some of these facilities are considerable distances from the ice skater's rest area. The proposed invention addresses these problems by providing comfortable ankle support during transportation and when walking over longer distances.

A second problem that exists with available ice skate blade guards is that ice skate blades rest on the bottom of the ice skate blade guard. Over time and prolonged use, the friction between ice skate blades and available ice skate blade guards causes a dulling of the ice skate blade. The invention included in this patent maintains ice skate blades in suspension eliminating the problem of unnecessary friction.

A third problem that exists with available ice skate blade guards relates to ice skate storage. The available ice skate blade guards do not facilitate the storage of ice skates. Because the width is ½" to ¾", ice skates cannot be made to stand upright except with the support of a wall or similar upright support structure. The invention included in this patent addresses this problem by providing support so that skates may be stored in an upright position that is free of any other support structure. This feature facilitates convenient storage.

The art has developed ice skate blade guards, U.S. Pat. No. 4,382,615, U.S. Pat. No. 3,135,526 and Canadian Patent No. CA1062301. that all relate to a cover that fits over the ice skate blade offering only temporary protection of ice skate blades. Each of these patents identifies ice skate blade guard concepts that provide little or no ankle support, poorly protect ice skate blades from unnecessary wear over long periods are provide no support structure for convenient storage. All three of these ice skate guards are basicaly alike except for the means by which they attach to the ice skate and methods used to alter the length of the ice skate blade guard to facilitate different ice skate shoe sizes. Generally, the patented guards are made of rubber (or similarly soft material) and are 1" or less in width. This width is not sufficient to provide ankle support and comfort for walking or during rest periods (e.g., ice skating recesses, between competitions). The invention included in the patent is 2½ to 3 times wider than available ice skate blade guards. The bottom of the invention included in this patent is approximately as wide as a standard shoe and is also shaped and curved like a shoe with a soft bottom, giving ankle support and stability. The additional width provides superior support and comfort during walking. The prior art ice skate blade guards also result in the dulling of ice skate blades with continuous use. The invention included in this patent allows the chassis of the skate to ride on the rail of the ice skate storage and walking shoe where the ice skate hangs in suspension. Finally, because the width of the ice skate storage and walking shoe is the width of a standard walking shoe, the ice skate is able to stand in an upright position for convenient storage. Each of these factors is important to users of ice skate blade gaurds.

OBJECTS AND SUMMARY OF THE INVENTION

The object of the invention included in this patent is to improve U.S. Pat. No. 5,765,870, the Inline Skate Storage and Walking Shoe. By placing an insert in the central cavity of the adjustable inline skate and walking shoe that will snuggly accept the blade of an ice skate, the walking shoe can accommodate ice skates. Because the insert is not permanent, the inline skate walking shoe can be used for either ice skates or inline (roller blade) skates. The insert that is approximately as wide as the inline skate storage and walking shoe cavity is placed in that cavity and contains a cavity of its own which may range in width from ⅛" to 3/16" in width. This smaller width is sufficient to accept ice skate blades (sometimes refered to as ice skate runners). Like the adjustable inline skate storage and walking shoe, the insert can be made in variable lengths to accommodate ice skate blades of various lengths. The adjustable inline skate storage and walking shoe with the invented insert will hereafter be referred to as the adjustable ice skate storage and walking shoe.

The overall object of the invention, the adjustable ice skate storage and walking shoe is to have a shoe that will slip over the blade of an ice skate with the chassis of the skate resting on the top lip of the insert. The bottom of the blade does not rest on the bottom of the cavity like available ice skate blade guards do. The insert is designed to keep the bottom of the blade in suspension and this feature facilitates sharp ice skate blades. Because ice skate blades rest on the base of available ice skate blade guard cavities, unnecessary friction and blade dulling occurs.

The ice skate can be quickly and easily slipped over the blades of the skate, strapped into place and used for comfortable and safe walking. The base of the ice skate storage and walking shoe is approximately as wide as a standard shoe. This width provides stability, comfort and additional safety.

There is a need for an inexpensive method for converting the adjustable inline skate storage and walking shoe to an ice skate storage and walking shoe. A person that wears both ice skates and inline skates may inexpensively convert from the inline skate storage and walking shoe to the ice storage and walking shoes at a minimal additional cost. A consumer may purchase the inexpensive insert and use the storage and walking shoe for either ice skates or inline skates.

BRIEF DESCRIPTION OF THE DRAWINGS

FIG. 4 is a top view of the ice skate inserts that will be placed in the front and rear half of the Adjustable Inline Skate Storage and Walking Shoe to accept the blade of the ice skate. This insert convert the unit to the Adjustable Ice Skate Storage and Walking Shoe.

Figure five is a side view of the ice skate insert.

FIG. 6 is a cross view of the ice skate insert.

FIG. 7 shows the Adjustable Inline Skate and Storage Shoe with the insert in place to accept an ice skate, becoming the Adjustable Ice Skate Storage and Walking Shoe.

Figure 8:
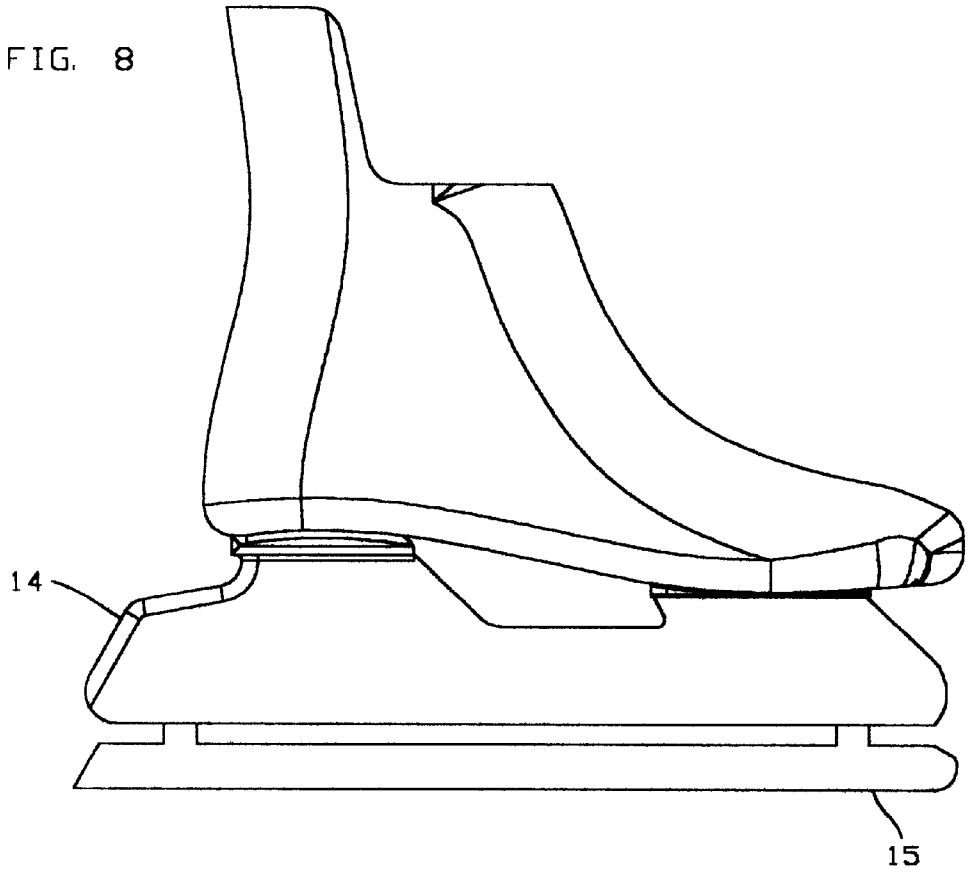

FIG. 8 shows the standard ice skate with the boot, chassis (that holds the blade) and ice skate blade. The chassis rides on the top ledge of the Adjustable Ice Skate Storage and Walking Shoe insert (the ice skate blade hangs in suspension).

Figure 9:
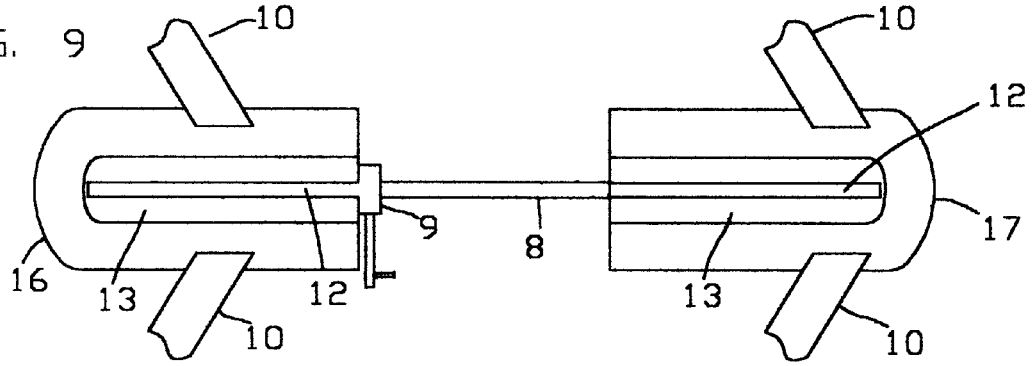

FIG. 9 shows an Adjustable Ice Skate Storage and Walking Shoe molded to accept the ice skate without the capability of accepting an inline skate.

DETAILED DESCRIPTION OF THE PREFERRED EMBODIMENTS

Figure 1:
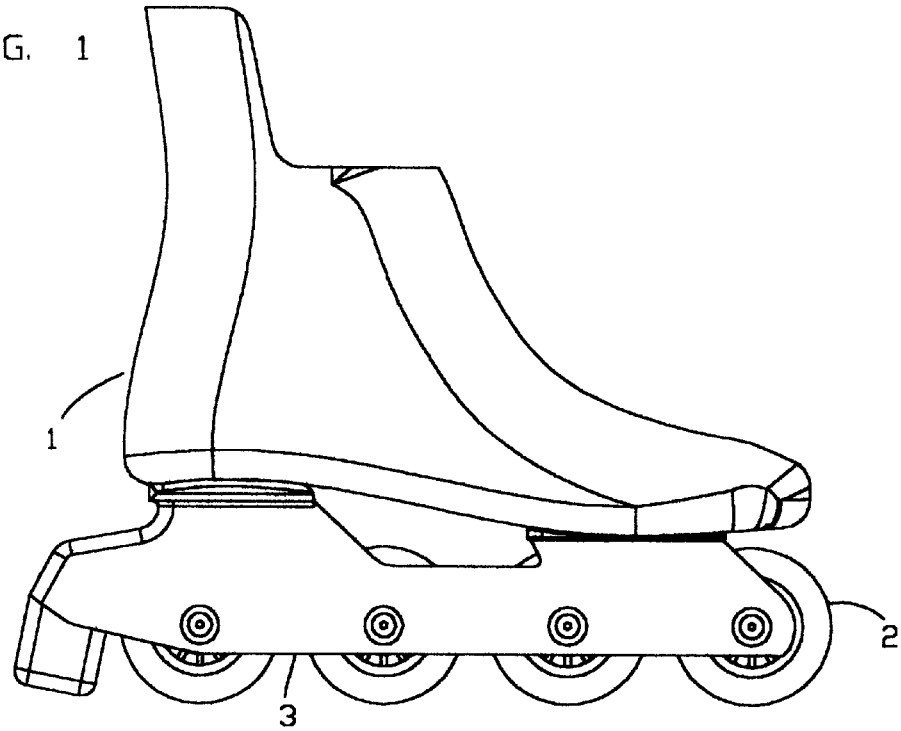
FIG. 1 is the side view of an inline skate, showing the chassis and wheels as on a standard inline skate.
Figure 2:
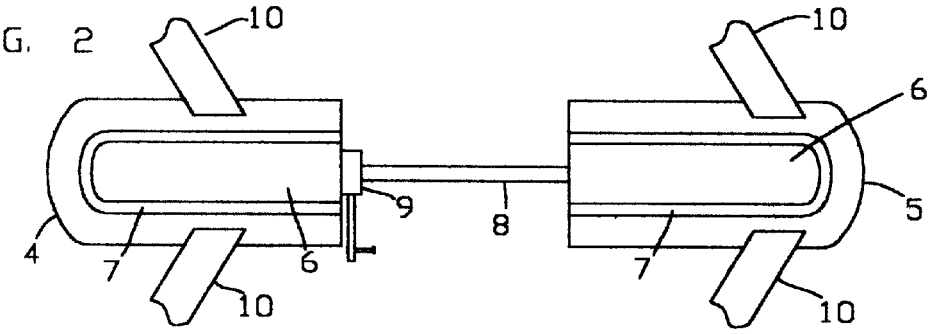
FIG. 2 is the present embodiment of the Adjustable Inline Skate Storage and Walking Shoe (within the claims of U.S. Pat. No. 5,765,870) ready to be mounted on an inline skate by slipping the wheels of the inline skate in to the cavity and strapping the shoe to the skate.
Figure 3:
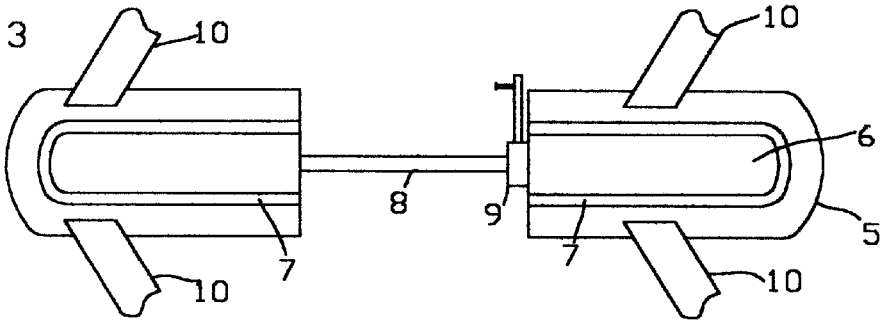
FIG. 3 shows the adjustment capacity of the invention.

The conventional inline skate is shown in FIG. 1: 1 shows the conventional boot; 2 shows the wheels of the inline skate; and 3 shows the chassis of the skate which hold a plurality of wheels. FIG. 2 shows the shows the Adjustable Inline Skate and Storage Shoe designed within the claims of U.S. Pat. No. 5,765,870: 4 shows the front half; 5 shows the rear section of the shoe; 6 is the cavity that the wheels of the skate drop into; 7 shows the top ledge of the walking shoe that the chassis of the inline skate rests on; 8 shows the adjustable shaft that connects the two halves; 9 shows the locking mechanism used to control the length of the shoe; 10 are the straps used to secure the shoe to the boot. FIG. 3 shows the expansion capabilities of the shoe. FIG. 4 shows the front and rear sections of the ice skate insert: 11 is the insert; 12 is the cavity that the blades of the ice skate drop into and 13 is the top ledge of the walking shoe that the chassis of the ice skate rests on. The ice skate insert can very in length depending on the length of the ice skate shoe. FIG. 5 shows a side view and FIG. 6 is a cross view of the ice skate insert. These inserts comprising of a solid material such as fiberglass, wood, plastic or similar such material can range from ½" to 1¼ in width depending on the size of the Adjustable Inline Skate Storage and Walking Shoe cavity (some inline skates have different wheel sizes; the wheels on some children's skates are some what narrower in width). Similarly, the depth of the ice skate insert can range from ½" to 1". The depth of the ice skate insert cavity will be less than 1" and the width of the ice skate insert cavity can range between ⅛" and 3/16". FIG. 7 is the Adjustable Inline Skate and Storage Shoe with the ice skate insert in place, ready to accept the ice skate. FIG. 8 is a ice skate: 14 is the chassis that will ride on the top ledge of the ice skate insert; 15 is the ice skate blade (runner) that will drop into the ice skate insert cavity. FIG. 9 is a Adjustable Inline Skate and Storage Shoe molded specifically to adapt to the ice skate: 16 is the front section with 17 being the rear section; 12 is the cavity for the ice skate blade; 13 is the top ledge that the ice skate chassis will rest. While the invention has been described in connection with certain preferred embodiments thereof, it is evident that many alternatives, modifications, and variations will be apparent to those in the art of the foregoing teachings. Accordingly the invention is intended to embrace all such alternatives, modifications, and variations that fall within the spirit and scope of the appended claims.

What is claimed is:

1. An adjustable shoe for maintaining an inline skate in a generally upright position adapted for use with an ice skate comprising:

(a) a front shoe portion having a front cavity sized and shaped to receive a front portion of an inline skate wheels, the cavity having a width and the front shoe portion having a bottom at least 2.5 times as wide as the cavity for the wheels;

(b) a rear shoe portion having a rear cavity sized and shaped to receive a rear portion of an inline skate wheels, the cavity having a width and the front shoe portion having a bottom at least 2.5 times as wide as the cavity for the wheels;

(c) a track extending between the front shoe portion and the rear shoe portion which maintains the front cavity in alignment with the rear cavity and permits the front shoe portion and rear shoe portion to be moved relative to one another;

(d) securing means for securing the front shoe portion and rear shoe portion to the inline skate; so that when an inline skate is placed in the adjustable shoe, the inline skate will be held in a generally upright position when the adjustable shoe is placed on a flat surface; and (e) an insert having a central cavity sized and shaped to receive an ice skate blade and exterior dimensions approximately corresponding to the width and depth of the front and rear cavities of said front and rear shoe portions so that upon receipt of an ice skate blade in said central cavity the insert fits snugly into the front and rear cavities of said front and rear shoe portions to maintain the ice skate in a generally upright position when the adjustable shoe is placed on a flat surface.

2. The adjustable shoe of claim 1 wherein the securing means is at least one strap attached to one of the front shoe portion and the rear shoe portion for securing the front shoe portion and the rear shoe portion to the ice skate.

3. The adjustable shoe of claim 1 wherein the securing means is at least one pair of securing plates attached to opposite sides of one of the front shoe portion and the rear shoe portion for securing the front shoe portion and rear shoe portion of the ice skate.

4. The adjustable shoe of claim 1 wherein the insert is made of a solid material selected from a group consisting of fiberglass, wood, rubber and plastic.

5. The adjustable shoe of claim 1 wherein the central cavity of the insert has a depth of less than 1 inch and width from ⅛ to 3⁄16 inch.

6. The adjustable shoe of claim 1 wherein the front shoe portion and the rear shoe portion are of a size, shape and weight to permit a wearer of a pair of ice skates, to each of which ice skates the adjustable shoe has been attached, to walk comfortably.

7. The adjustable shoe of claim 1 having a soft sole attached to the front shoe portion and a soft heal attached to the rear portion.

8. The adjustable shoe of claim 3 wherein at least one pair of securing plates is adjustably attached to permit each securing plate to be moved toward and away from a boot of an ice skate placed in the adjustable shoe.

9. The adjustable shoe of claim 5 wherein the insert is sized and shaped so that the chassis of the ice skate rides on the top of the insert to prevent the ice skate blade from resting on the bottom of the insert cavity.

* * * * *